United States Patent [19]

Conly

[11] 4,421,404

[45] Dec. 20, 1983

[54] JOB RECOVERY TECHNIQUE IN A DOCUMENT COPIER MACHINE

[75] Inventor: Douglas J. Conly, Boulder, Colo.

[73] Assignee: International Business Machines Corporation, Armonk, N.Y.

[21] Appl. No.: 374,848

[22] Filed: May 4, 1982

[51] Int. Cl.[3] ..... G03G 15/00

[52] U.S. Cl. ..... 355/14 CU; 355/14 R; 355/14 SH; 271/3.1

[58] Field of Search ..... 355/14 CU, 14 R, 14 SH, 355/3 SH, 3 R, 50, 77; 271/3.1, 4, 5, 6, 7

[56] References Cited

U.S. PATENT DOCUMENTS

| | | | |
|---|---|---|---|
| 4,078,787 | 3/1978 | Burlew et al. | 271/3.1 |
| 4,192,607 | 3/1980 | Hage | 355/50 |
| 4,206,996 | 6/1980 | Clark et al. | 355/14 C |
| 4,212,457 | 7/1980 | Guenther | 355/14 SH X |
| 4,229,100 | 10/1980 | Travis | 355/77 |
| 4,229,477 | 11/1981 | Ward et al. | 355/14 R |
| 4,327,993 | 5/1982 | Gauronski et al. | 355/3 SH X |
| 4,338,023 | 7/1982 | McGibbon | 355/3 SH X |

*Primary Examiner*—A. C. Prescott
*Attorney, Agent, or Firm*—C. E. Rohrer

[57] ABSTRACT

A document copier machine with an automatic document feeder (ADF) combined with a semiautomatic document feeder (SADF) is operated according to a job recovery procedure in which multiple originals may need recopying in order to replace copies destroyed when a jam occurs. The procedure calls for feeding the required number of originals needed for recopy through the SADF and once the jam recovery is complete, automatic restarting of the ADF occurs in order to complete the job interrupted by the jam.

9 Claims, 8 Drawing Figures

JOB RECOVERY TECHNIQUE IN A DOCUMENT COPIER MACHINE

This invention relates to document copier machines and more particularly relates to a technique for automatically restarting an automatic document feeder following recovery from a paper jam.

BACKGROUND OF THE INVENTION

In electrophotographic document copier machines, copies of documents or other subjects are produced by creating an image of the subject on a photoreceptive surface, developing the image and then fusing the image to copy material. In machines which utilize plain bond copy paper or other ordinary image receiving material not specially coated, the electrophotographic process is of the transfer type where a photoreceptive material is placed around a rotating drum or arranged as a belt to be driven by a system of rollers. In the typical transfer process, photoreceptive material is passed under a stationary charge generating station to place a relatively uniform electrostatic charge, to a potential which is usually several hundred volts, across the entirety of the photoreceptive surface. Next, the photoreceptor is moved to an imaging station where it receives light rays reflected from the document to be copied. Since white areas of the original document reflect large amounts of light, the photoreceptive material is discharged in white areas to relatively low levels while the dark areas continue to contain high voltage levels even after exposure. In that manner, the photoreceptive material is caused to bear a charge pattern which corresponds to the printing, shading, etc. present on the original document and is therefore, an electrostatic image of that document.

Electrophotographic machines may also be organized to provide a printing function where the image on the photoreceptive surface results from character generation rather than from an optical review of an original document. Character generation may be produced, for example, by driving a light generating source from information held in digital memory. The generating source may be a laser gun, an array of light-emitting diodes, light modulators, etc. which direct light rays to the photoreceptor and cause it to bear a charge pattern which is an image of the information used to drive the generating source.

After producing an image on the photoreceptor, the next step in the process is to move the image to a developing station where developing material called toner is placed on the image. This material may be in the form of a black powder which carries a charge opposite in polarity to the charge pattern on the photoreceptor. Because of the attraction of the oppositely charged toner, it adheres to the surface of the photoreceptor in proportions related to the shading of the original. Thus, black character printing should receive heavy toner deposits, white background areas should receive none, and gray or otherwise shaded half-tone character portions of the original should receive intermediate amounts.

The developed image is moved from the developer to a transfer station where a copy receiving material, usually paper, is juxtaposed to the developed image on the photoreceptor. A charge is placed on the back-side of the copy paper so that when the paper is stripped from the photoreceptor, the toner material is held on the paper and removed from the photoreceptor. Unfortunately, the transfer operation seldom transfers 100% of the toner from the receptor to the copy paper.

Toner remaining on the photoreceptor after transfer is called residual toner.

The remaining process steps call for permanently bonding the transferred toner material to the copy paper and cleaning the residual toner left on the photoreceptor so that it can be reused for subsequent copy production.

In the cleaning step, it is customary to pass the photoreceptor under a preclean charge generating station to neutralize the charged areas on the photoreceptor. The photoreceptor may also be moved under an erase lamp to discharge any remaining charge. In that manner, the residual toner is no longer held by electrostatic attraction to the photoreceptive surface and thus it can be more easily removed at a cleaning station.

In order to avoid overburdening the cleaning station, it is customary to remove all charge present on the photoreceptive surface outside of the image area prior to the development step. This is usually done by using an interimage erase lamp to discharge photoreceptive material between the trailing edge of one image and the leading edge of the next. Also, erase lamps are used to erase charge along the edges of the photoreceptor outside of the image area. For example, if the original document is 8.5×11 inches in size, and if a full sized reproduction is desired, the dimensions of the image on the photoreceptor will also be 8.5×11 inches. The interimage and erase lamps remove charge outside of the 8.5×11-inch image area.

A common variation on the above-described process used in many electrophotographic machines involves the use of specially prepared paper where the copy paper itself carries a coating of photosensitive material. By utilizing that technique, the image is electrostatically painted directly on the copy paper. The copy paper is sent through a developer and then to a fuser for permanent bonding. Machines of this type avoid the residual toner problem and therefore there is no need for cleaning stations, erase lamps, preclean generating coronas, etc. However, the resulting copy paper with its special photosensitive coating is much more expensive than plain bond copy paper and the special coating is considered to detract from the resulting product. As a consequence, coated paper machines are usually favored only for low volume applications or where quality product is not essential.

In addition to the fundamental mechanisms used for producing a copy or print, modern electrophotographic machines have been developed with many features which are designed to ease the difficulty of using the machines. For example, semiautomatic (SADF) and automatic (ADF) document feed devices, including a variety which recirculates the originals, ease the entry of documents to be copied. Collators are often added to the base machine so that collated sets of copies can be automatically produced. Many machines have a duplex function so that copies can be produced on both sides of the copy sheet. Other features add to machine versatility such as the production of copies which are a reduced or magnified version of the original document. Other features improve copy quality such as mechanisms for controlling the concentration of toner in machines which utilize a carrier/toner development mix. Many modern electrophotographic machines are controlled by microprocessors rather than by hardwired analog or digital logic. The use of microprocessors has enabled the addition of many new innovative functions at low cost such as, for example, error logs and automatic diagnostic capabilities to ease troubleshooting and improve maintenance. Microprocessor routines have also aided in the establishment of a degree of "artificial intelligence" to anticipate the needs of the machine user in document feed operations, collate, and other areas. Additionally, microprocessors have made economical the addition of innovative functions such as the provision of separator sheets between different sets of copies within a collator.

As may be appreciated from the above, the basic electrophotographic machine involves the interaction of several important subsystems to produce a copy sheet or print and several other subsystems which control copy quality or which provide convenience functions. In addition, modern copier machines have been developed to run at high speeds so that, at any one time, several copy sheets can be located along the copy paper path from the image-receiving station to the exit station. These sheets can all be copies of the same original document, but in many cases these sheets will bear an image of more than one original. As a result, if a paper jam occurs necessitating a machine shutdown and a clearing of all sheets in the copy paper path, copies of several different originals might be thrown away thereby causing a need to recopy these same several different originals in order to recover from the jam. U.S. Pat. No. 4,229,100 to Travis (IBM) discloses such a machine and describes a system which utilizes counts for precisely recovering from loss of copy sheets due to a jam or other stoppage conditions. In the described system, the maximum number of originals for which recopies might need to be made is limited to three and the system identifies the number of originals, one, two, or three which need to be recopied. A similar technique is used on the commercially available IBM Series III Copier/Duplicator. However, the system described by Travis, as well as commercially available machines, require the insertion of makeup originals by the machine user, and, after jam recovery, require operator intervention to restart the job interrupted by the work stoppage.

SUMMARY OF THE INVENTION

Briefly stated, this invention relates to job recovery in an electrophotographic copier machine with an automatic document feed device, wherein a number of copy sheets bearing images of several original documents may be present in the copy paper path at a given instant. When a jam occurs in such a machine, the job recovery technique of this invention calls for clearing the jam, inserting all original documents to be recopied, preferably through a semiautomatic document feeder in a machine so equipped, and, upon conclusion of such jam recovery, automatically restarting the document feed device without further operator intervention.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

RELATED DOCUMENTS

This invention is to be described in the context of the IBM Series III Copier/Duplicator. For a complete description of the subsystems of this copier, reference should be made to Service Manual, P/N 1677450, or to P/N 1674073; for a description of jam recovery procedures to U.S. Pat. No. 4,229,100, mentioned above; and U.S. Pat. No. 4,170,414 which describes the microprocessor used in the machine.

DETAILED DESCRIPTION

Figure 1:
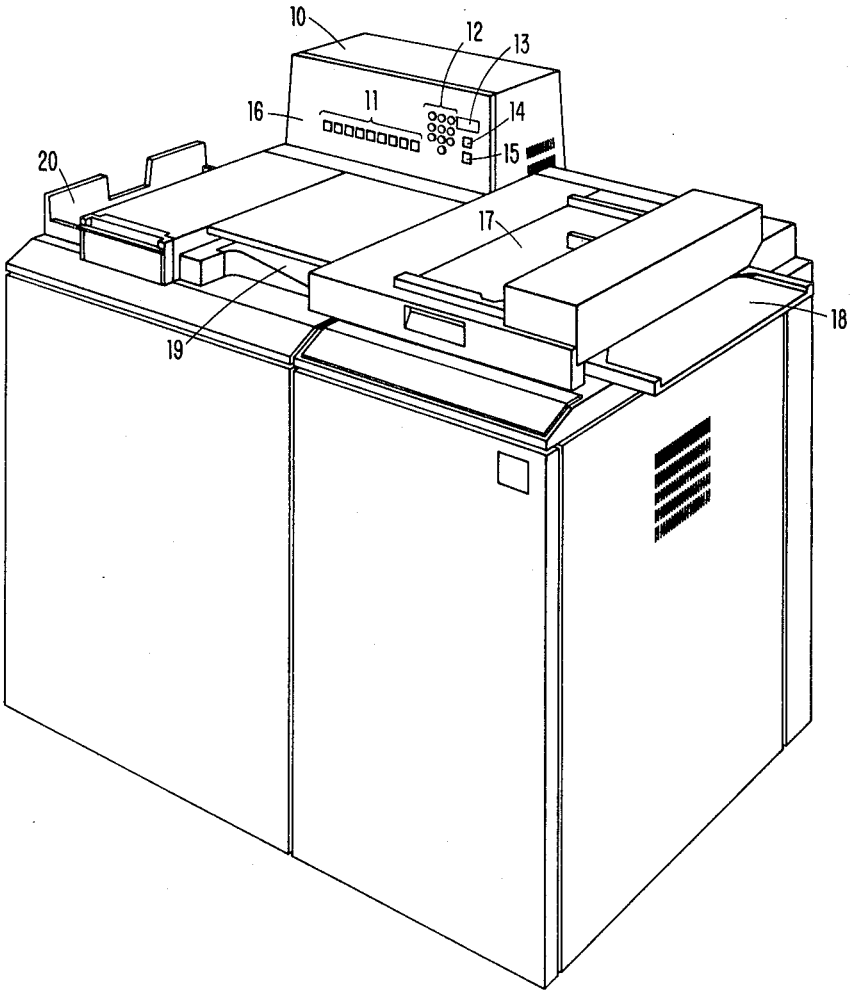
FIG. 1 is a perspective view of one model of the IBM Series III Copier/Duplicator, which machine may incorporate the invention job recovery procedure.

FIG. 1 shows a perspective view of the IBM Series III Copier/Duplicator. Control tower 10 contains a set of keys or buttons 11 which may be selected by an operator to instruct the machine to perform various functions. For example, this set of keys contains a push button for a first reduction mode, another for a second reduction mode, one for the duplex operation, one for collate, another for separate, for interrupt, buttons for a light copy or dark copy mode, and others. The number of copies to be made is selected by the operator from the push buttons 12 with the number selected appearing in numeric display 13. Control tower 10 also contains a start button 14 and a stop reset button 15. Messages to instruct the operator to take corrective action appear in the area 16.

FIG. 1 also shows a tray 17 for the automatic document feed. A stack of original sheets may be fed one at a time automatically from this tray to the document processing station. Tray 18 is provided to accept sheets from the hand of the operator one at a time for semiautomatically feeding sheets to the processing station. After processing, the original documents are exited into an area 19 and the finished copy sheet is exited into a tray 20. FIG. 1 does not show a collator module with the machine.

Figure 2:
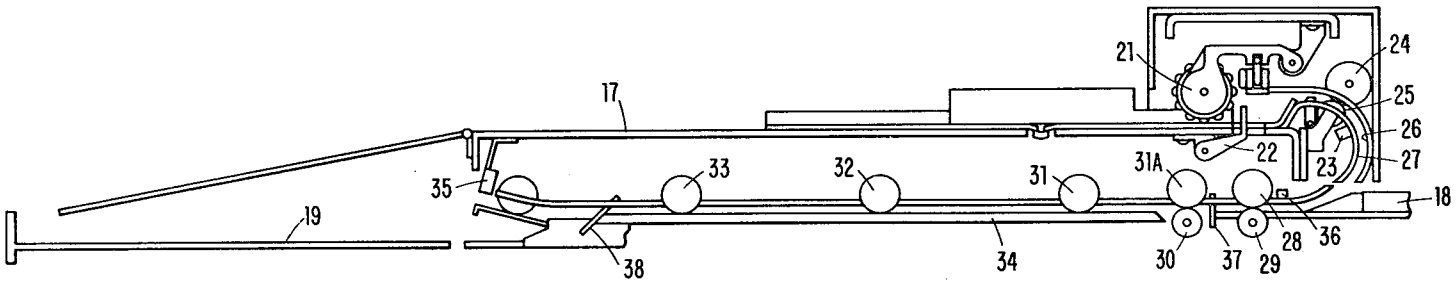
FIG. 2 is a diagrammatic view of the major functional mechanisms used in an automatic/semiautomatic document feed device for use with the machine of FIG. 1.

FIG. 2 is a diagrammatic front view of the automatic document feed/semiautomatic document feed (ADF-/SADF) used with the Series III. To use the ADF, a stack of original documents is placed on the ADF tray 17 and pushed forwardly under a sheet feeding means 21 to a gate 22. When positioned, gate 22 automatically drops out of the way and original documents are fed one at a time by the paper feeding wheel 21 into nip rollers 24 and 25. When the leading edge of the first document is sensed by photosensor 23, the feed wheel 21 is lifted from the top surface of the first sheet and nip rollers 24 and 25 are halted. When the copying machine is ready to receive the first sheet, rollers 24 and 25 are automatically reenergized to feed the first sheet through turnaround guides 25 and 27 to aligning rolls 28 and 29, pinch rolls 30 and 31A, and onto document glass 34. The original document is moved across document glass 34 under the influence of rollers 31, 32, and 33 which bear against the top of the document as it moves across the glass to its registration position at exit gate 38 where it is held stationary during the copying operation. During the copying operation, feed wheel 21 is lowered onto the stack of documents for feeding the second sheet from the top of that stack through nip rollers 24 and 25 until the leading edge reaches photosensor 26. At that time, feed wheel 21 is lifted from the top of the stack and nip rollers 24 and 25 are deenergized. The second sheet remains in that staged position until completion of the copying of the first sheet. When the copy operation is completed, exit gate 38 drops and the first sheet is exited past photosensor 35 into the exit area 19. At this time, nip rollers 24 and 25 are reenergized and the second sheet is fed to the processing position on document glass 34.

When it is desired to utilize the semiautomatic document feed, the operator places a document onto tray 18 and inserts that document into the vicinity of photosensor 36 which energizes alignment rolls 28 and 29. The alignment rolls take the paper from the operator's hand and move it to entry gate 37. When the machine is ready to receive the document, entry gate 37 is automatically dropped and the paper is fed to document glass 34 by the aligner rolls, by pinch rolls 30 and 31A, and across the document glass by rollers 31, 32, and 33 to the registration position at exit gate 38, where the document is held stationary during the copying operation. At the conclusion of the copying operation, exit gate 38 drops and the document exits past the exit sensor 35 into the exit area 19.

Figure 3:
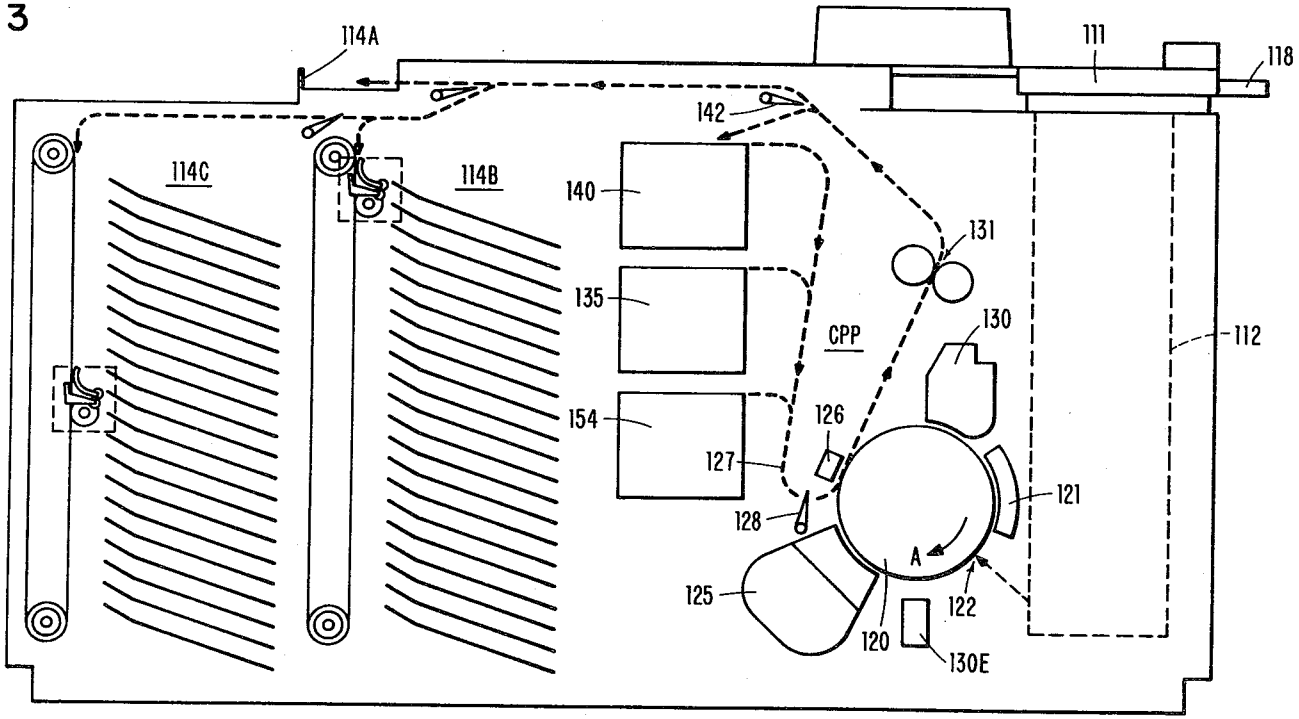
FIG. 3 is a view of the paper path of the machine of FIG. 1 showing two collator modules attached to the base machine.

FIG. 3 is a drawing taken from U.S. Pat. No. 4,170,414, referenced above, which shows the copy paper path (CPP) of the Series III Copier/Duplicator. Note that in this figure, two collator modules 114B and 114C have been attached to the basic operating unit. In this machine, a drum 120 rotates in a direction A past a corona generator 121 which places a relatively uniform charge across the photoreceptive surface of the drum. Further rotation of the drum brings the charged photoreceptive surface past an imaging station 122 where the image of the original document is placed on the photoreceptive surface. Erase lamps 130E erase the charging area of the photoreceptor outside of the defined image area. The image is developed by developer 125 and transferred to a sheet of copy receiving material under the influence of transfer corona 126. The photoreceptive surface continues to rotate to cleaning station 130 where the photoreceptor is cleaned and prepared for the next copying operation.

In order to produce an image at imaging station 122, an original document is placed at a processing station 111 either manually, by an automatic document feed, or by a semiautomatic document feed as described above. The image of the original document is produced by scanning the original document through an optics module 112 which is fully described in U.S. Pat. No. 3,897,148.

Copy receiving material is located in bins 135 and 154 and is fed from either one of those bins into the copy paper path 127 to gate 128. At the proper time in the operating cycle, gate 128 releases the copy sheet so that it can be moved through transfer station 126 to receive an image from the rotating drum 120. The copy paper continues through fusing rolls 131 to the exit tray 114A or into one of the two collator modules 114B or 114C. Should the duplexing function be selected, the copy sheet will be diverted by gate 142 into duplex bin 140 from which it is fed back into the copy paper path to receive the image of an original on the opposite side of the sheet.

Figure 4:
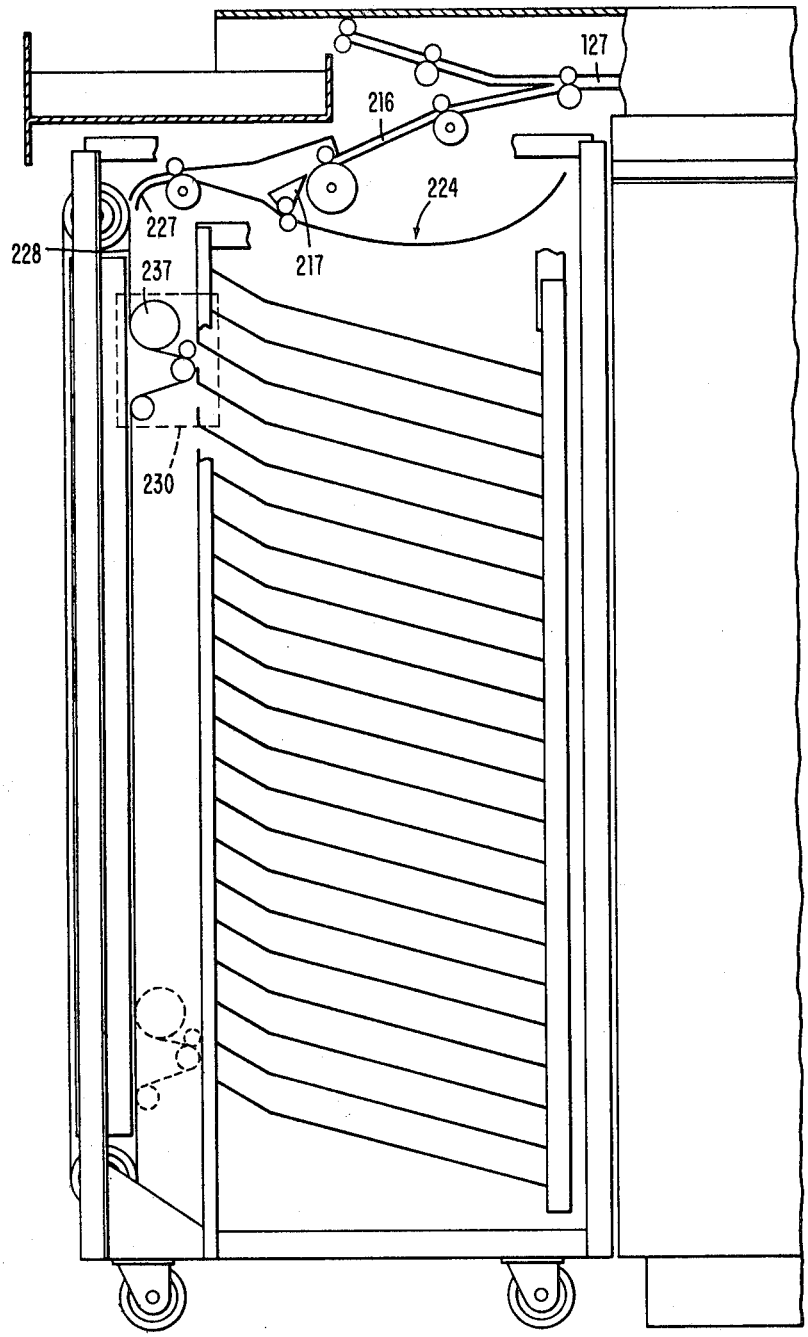
FIG. 4 is a detailed view of the paper path within the first collator module.

FIG. 4 is a drawing taken from U.S. Pat. No. 4,216,955 to explain the functioning of the collator. A paper entering the collator along the path 127 is directed along path 216, over closed gate 217, through throat 227, along the belt 228, and into the traveling distributor or vane 230 which sends the paper into the selected collator bin. When collating duplexed documents, gate 217 is open and the entering paper sheet is redirected into the inverter 224 before being fed through the throat 227 into the collator bins.

One of the notable features of the IBM Series III Copier/Duplicator is the separate function described in U.S. Pat. No. 4,285,591. This function may be used if two successive jobs are to be run on the machine using the collator but it is desired to avoid removing the first collated set until both jobs are finished. Thus, for example, a first job, utilizing $8\frac{1}{2}\times 11$ inch copy paper is run placing sheets in the first five bins of the collator shown in FIG. 4 and then, at the end of that job, a "separate" sheet, that is, a sheet from the alternate paper bin, is fed into each one of the five bins. Since sheets from the alternate paper bin may be, for example, a legal size sheet, $8\frac{1}{2}\times 14$ inches, this "separate" sheet would clearly set apart the first job from the second collate job. It should be noted that the separate sheet may be run at the close of the first job in which case it is called a trailing separate sheet or at the beginning of the second job, at which time it is called a leading separate sheet. Whether a leading or a trailing separate sheet is run depends upon the time at which the operator pushes the separate button. If the button is pushed during running of the first job, a trailing separate sheet is provided. If the separate button is selected with the setup of the second job, a leading separate sheet is provided.

Another notable feature of the IBM Series III is the provision of an interrupt function whereby a first job, being performed on the ADF, for example, can be suspended by an operator pressing an "interrupt" button on the control panel. A second job can then be run on the SADF, for example, and when the second job is finished, the operator can then resume the first job.

As mentioned, the IBM Series III is a high-speed copier machine with a relatively long copy paper path extending from the paper bins through the transfer station 126 to the bottom one of the collator bins. This path at any given instant may contain several imaged copy sheets. When a jam occurs in this machine, the initial requirement is that the entire copy paper path must be cleared of all paper and therefore several imaged copy sheets may be lost in the jam recovery procedure. These copy sheets may bear the image of more than one original. For example, two or three originals can be imaged on these sheets. In the invention now to be described, once the copy paper path is cleared, a job recovery procedure is set forth wherein all of the originals needed to be recopied may be fed to the document glass through the semiautomatic document feed and once completed, the job will automatically resume through the feeding of documents still in the stack on the automatic document feed tray.

Figure 5:
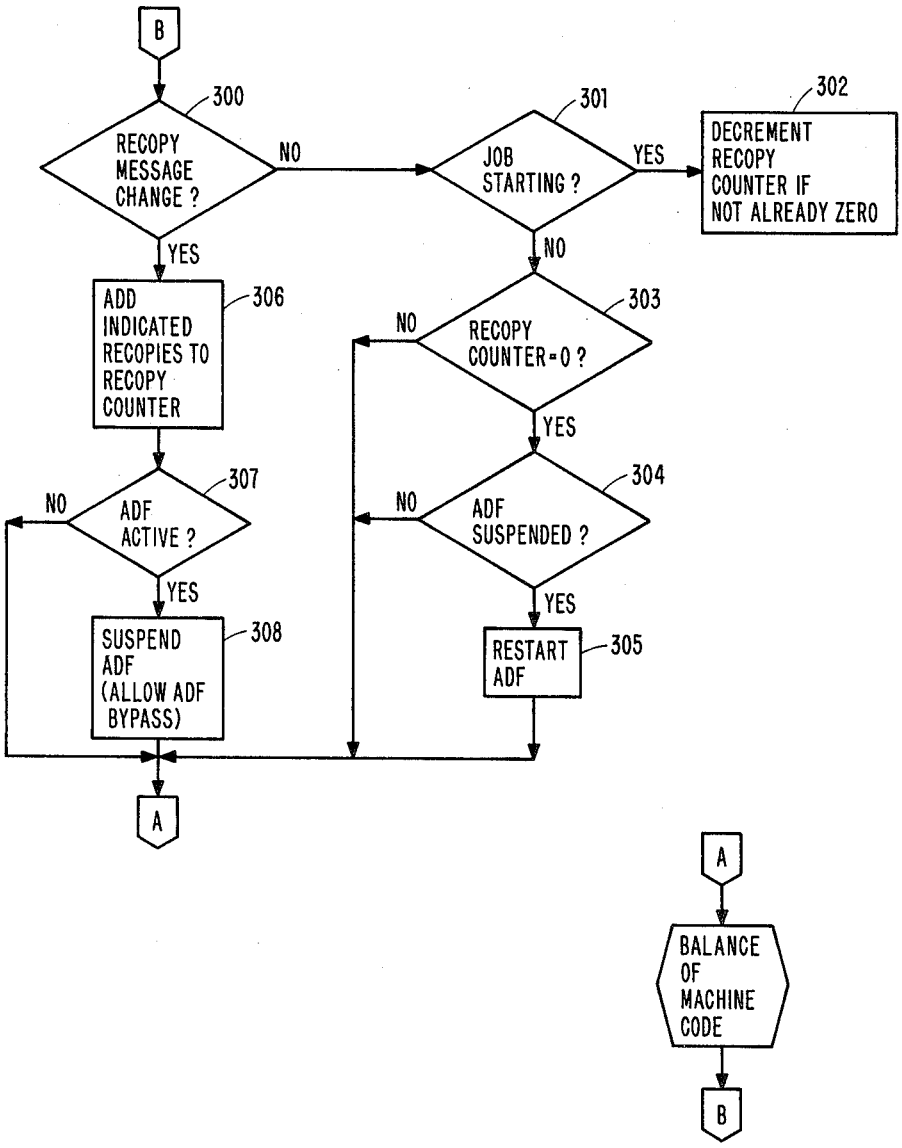
FIG. 5 is a schematic flowchart showing the technique of the instant invention.

FIG. 5 is a generalized flowchart showing the inventive procedure. The procedure is periodically entered by the machine control to determine whether any job recovery actions are needed. Entry is made into the procedure at decision step 300 for a query of whether a recopy message change has occurred. For example, if the machine is running smoothly without a jam, the result of the query at step 300 is to ascertain that no changes have occurred causing a branch to decision step 301 for a query as to whether a job is starting. If it is, a branch is made to step 302 in order to decrement the recopy counter. If, as we assumed, the machine is running smoothly, the recopy counter is already zero and no change will occur at step 302. Next, a query at decision step 303 inspects the recopy counter to ascertain whether it is equal to zero. Since it is equal to zero in the present example, a query is made at step 304 as to whether the automatic document feed operation has been suspended due to a recopy requirement. Since the job is running smoothly, machine control has now determined that no job recovery actions are needed and therefore a branch is taken at this point to step A for a running of the balance of the machine code in the regular production of copies.

If recovery from a jam had been underway but is now complete, the query at decision step 303 will indicate that the recopy counter is equal to zero, and step 304 will indicate that the automatic document feed has been suspended. This rsult causes a branch to step 305 for the automatic restarting of the automatic document feed and in that manner a resumption of the job interrupted by the jam.

Let us assume now that entry to decision step 300 has occurred after a jam requiring the recopying of three originals. In this instance, a recopy message change will be sensed at step 300 and therefore a branch will be taken to step 306 for adding the indicated number of recopies to the recopy counter. Next, at step 307, the query is made, has the automatic document feed been active, and if it has, further ADF operation will be suspended and the SADF will be authorized for use so that the needed makeup copies can be made through the SADF if desired. Alternatively of course, the operator may lift the cover and place the originals to be recopied directly on the document glass in a manual manner.

Doing so, however, may disturb the stack of originals to be copied remaining on the ADF tray and therefore use of the SADF is preferred. Also, of course, use of the SADF is faster and more convenient.

At this point in the procedure, the operator must place the first original to be recopied on the document glass, for example, by using the SADF. After this occurs, the next entry by machine control into the procedure shown in FIG. 5 at step 300 will indicate that there has been no recopy message change (assuming that the recopying of the needed makeup copies is proceeding normally), thereby causing a branch to step 301 to ask whether the job has started. If it has, the recopy counter will be decremented by one at step 302 and a determination will be made at step 303 as to whether the recopy counter is now equal to zero. Assuming that it is not, a branch will be taken back through the balance of the machine code in order to produce the next copy. The procedure will continue in this manner until the recopy counter is found equal to zero at step 303 after which a branch will be taken to step 304 to ask whether the ADF has been suspended. If it is, a branch is taken to step 305 so that the ADF can be automatically restarted in order to run the balance of the job interrupted when the jam occurred.

Figure 6A:
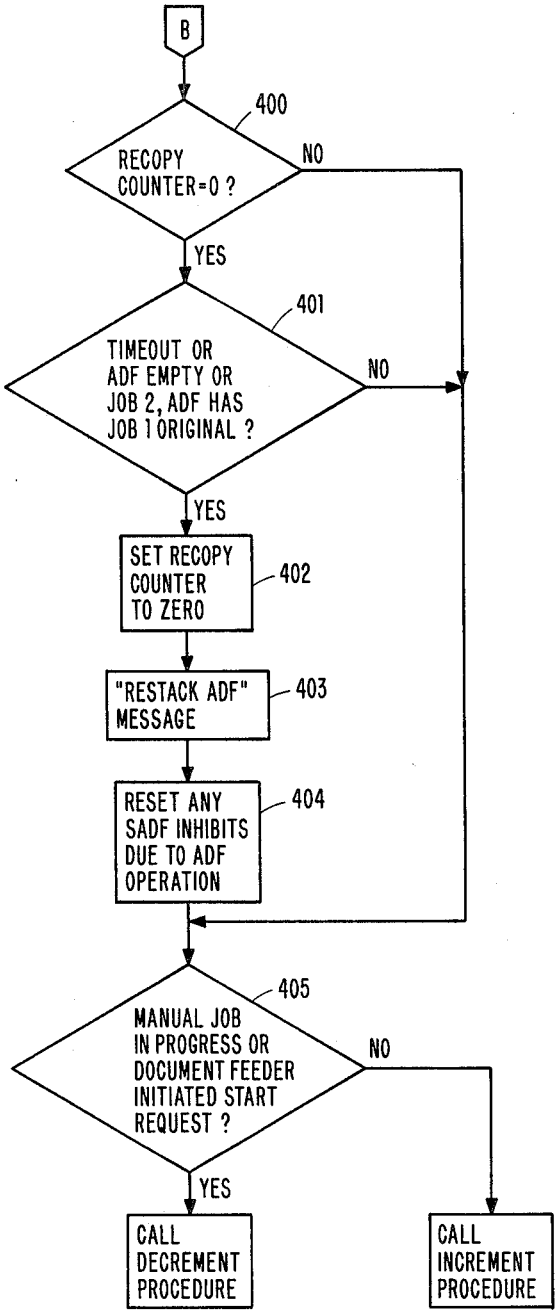
FIG. 6 comprised of FIGS. 6A–6C, is a detailed flowchart showing an implementation of the instant invention in the environment provided by the machine of FIGS. 1–4.
Figure 6B:
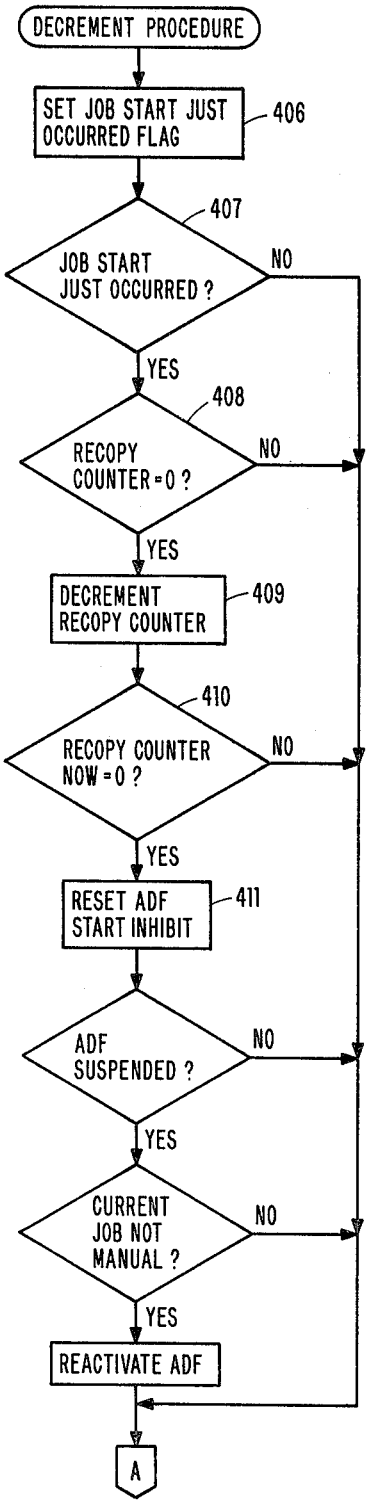
Figure 6C:
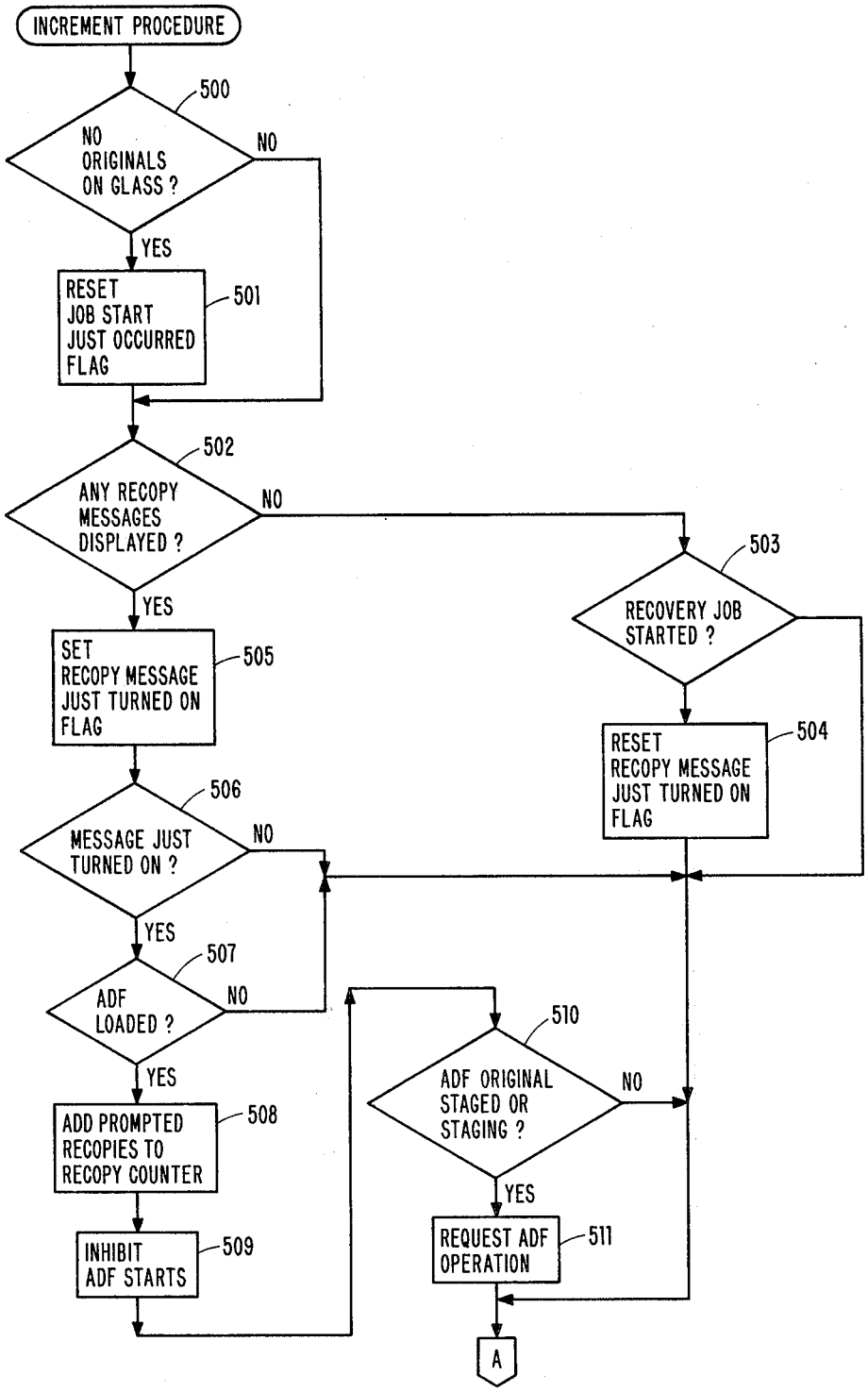

FIG. 6 comprised of FIGS. 6A–6C, shows a detailed version of the procedure of this invention as it is implemented on the IBM Series III Copier/Duplicator. The procedure shows that whenever a job recovery message is turned on, the recopy originals counter is recomputed and incremented to the current value in the counter plus the number of requested recopies. During the next copy run, this counter is decremented each time a document feeder original is committed to be copied. In that manner, the needed number of originals are tracked in order to provide the number of copies needed for complete jam recovery.

The procedure also causes the suspension of the ADF if it is active whenever a "recopy last N originals" message occurs. This allows the SADF to be used to recopy the originals to recovery from the jam.

The procedure also updates the "recopy originals remaining" counter each time a job recovery message is turned on or each time a document feeder original is committed to be copied. Then, if no recopy originals remain, the automatic document feed is restarted if it had been suspended.

In the procedure, the recopy originals counter is reset to zero whenever the ADF is unloaded or whenever an unexpected even occurs indicating that the job is not proceeding properly. This is exampled by the 30-second timeout on the selected job features whenever activity is absent for that time period. It is also exampled by an interrupted job where a state change occurs on the interrupted job.

The structure of FIG. 6 is as follows. FIG. 6A is a setup routine to insure that it is in order to run the job recovery procedure, that is, the job is not so fouled that automatic job recovery cannot be run successfully. FIG. 6C is an incrementing subroutine performed upon discovery of the jam by the machine. This procedure adds the number of recopies needed to recover to the recopy counter and inhibits the ADF until jam recovery is complete. FIG. 6B is a decrementing subroutine performed during jam recovery to decrement the recopy counter each time a copy is started. This procedure also reactivates the ADF upon completion of the jam recovery so that the job interrupted by the jam is automatically resumed upon completion of jam recovery.

Entry is made to the procedure at step 400, FIG. 6A, for an inspection of the recopy counter. Assuming that a jam has occurred and that the recopy counter is not equal to zero, a branch is taken to step 401 to determine whether some unusual event has occurred that indicates that the entire job has been fouled and therefore a job recovery procedure is not in order. The queries at step 401 call for an inspection of the 30-second timeout on selected features, whether the automatic document feed is empty, or whether a state change has occurred on an interrupted job. If the query at step 401 indicates that job recovery is unnecessary, a branch is made to step 402 to reset the copy counter equal to zero and at step 403 to produce a restack ADF message. Any inhibitions on the use of the SADF are reset at step 404. In that manner, the machine is cleared for whatever action the operator now wishes to take.

Assuming that the entire job has not been fouled but that a jam has occurred necessitating a recovery, a branch is taken at step 401 to step 405, FIG. 6B. At step 405, the query is to determine whether the first job recovery step has begun, that is, the operator has begun to feed the first original needed to be recopied. If this query is answered in the affirmative, a branch is taken to step 406 for setting the "job start just occurred" flag causing a query of that flag at step 407 to be answered in the affirmative. In that event, a query is made at step 408 whether the recopy counter is not equal to zero. Since it has been assumed that we are in the process of making recopies, the query at 408 will be anwered in the affirmative causing a branch to step 409 to decrement the recopy counter by one. The query is then made at step 410 to ascertain whether the recopy counter is now equal to zero. If it is, the last recopy of the necessary number of recopies has been started. This result causes a resetting of the automatic document feed start inhibit at step 411 thus enabling the ADF for automatic resumption of the interrupted job. However, if the query at step 410 is negative, it is indicated that more recopies need to be made and a branch is made back through the procedure once again.

Returning now to step 405, observe that if a job start has not just occurred, a branch is taken to FIG. 6C to step 500 to ask whether any originals are on the document glass. If no originals are on the glass, a branch is made to step 501 to reset the "job start just occurred" flag. Next, the query is made at step 502 as to whether a recopy message is being displayed, that is, is job recovery in order. If further recopies are not necessary, a branch is taken to step 503 to ask whether a recovery job has started. If a job has started, the "recopy message just turned on" flag is reset at step 504 and return is made to run the balance of the machine code.

Assuming that the query at step 502 is answered in the affirmative, that is, a recopy message is displayed, the "recopy message just turned on" flag is set at step 505 and the query at step 506 is answered in the affirmative. Next, the query at step 507 determines whether the automatic document feed is loaded. If it is, the recopy counter is incremented to add the number of recopies needed to recover from the particular jam which has just been discovered. This occurs at step 508 following which the automatic document feed start is inhibited at step 509 and a query is made at step 510 as to whether the automatic document feed has been active, that is, has an original been moved into the staging position or is it moving toward that position. An affirmative result causes a branch to step 511 where a suspension of further automatic document feed activity is requested. This halts the ADF after staging is complete for the balance of jam recovery.

Thus it may be observed that FIG. 6C is the procedure which is designed to set the number of needed recopies into the recopy counter upon the first discovery by the procedure of the fact that a jam recovery must occur. FIG. 6C also illustrates the suspension of ADF operation. FIG. 6B is the procedure followed thereafter in order to decrement the recopy counter each time the operator has fed another one of the originals needed to recover from the jam. FIG. 6B also shows the procedure for automatically reactivating the ADF when jam recovery is complete. FIG. 6A shows the procedure for insuring that the jam and job recovery procedures of FIGS. 6A and 6B will not occur if for some reason the entire operation has been fouled.

The Table below illustrates the verbal language code needed to implement the flowcharts shown in FIG. 6.

TABLE

| RECOPCNT |
|---|
| BEGIN SEGMENT (RECOPCNT) |
| 1. IF ANY ORIGINALS REMAIN TO BE RECOPIED |
| 1. THEN |

TABLE-continued

| RECOPCNT |
|---|
| 2. IF THE ORIGINALS ARE FOR THE JOB WHICH WAS INTERRUPTED BY THIS JOB |
| -OR- NO ORIGINALS ARE IN THE ADF |
| -OR- A FEATURES TIMEOUT JUST OCCURRED |
| 2. THEN |
| 3. ZERO THE RECOPY ORIGINALS COUNTER; |
| 3. REQUIRE THE ADF TO BE RESTACKED; |
| 3. ALLOW SADF INSERTIONS; |
| 2. ENDIF; |
| 1. ENDIF; |
| 1. IF A DOCUMENT FEEDER JOB IS BEING STARTED |
| -OR- A MANUAL JOB IS IN PROGRESS |
| 1. THEN |
| 2. IF THE JOB JUST STARTED |
| 2. THEN |
| 3. SAVE THE 'JOB IN PROGRESS' FLAG; |
| 3. IF THE RECOPY ORIGINALS COUNTER IS NOT ALREADY ZERO |
| 3. THEN |
| 4. DECREMENT THE RECOPY ORIGINALS COUNTER; |
| 4. IF NO ORIGINALS REMAIN TO BE RECOPIED |
| 4. THEN |
| 5. CANCEL THE ADF START INHIBIT; |
| 5. IF THE ADF IS SUSPENDED |
| 5. THEN |
| 6. IF THE JOB IN PROGRESS IS NOT A MANUAL JOB |
| 6. THEN |
| 7. CALL (SHINGRQ) |
| AUTOMATICALLY RESTART THE ADF; |
| 6. ENDIF; |
| 5. ENDIF; |
| 4. ENDIF; |
| 3. ENDIF; |
| 2. ENDIF; |
| 1. ELSE |
| 2. IF NO ORIGINAL IS STATIONARY ON THE DOCUMENT GLASS |
| 2. THEN |
| 3. RESTART THE JOB START HISTORY FLAG; |
| 2. ENDIF; |
| 2. IF ANY OF THE 'RECOPY ORIGINALS' MESSAGES IS ON |
| 2. THEN |
| 3. IF THE RECOPY MESSAGE COUNT HAS NOT BEEN ADDED TO THE CUMULATIVE RECOPY COUNT YET |
| 3. THEN |
| 4. FLAG THE CUMULATIVE COUNT AS UPDATED; |
| 4. IF AN ORIGINAL FOR THIS JOB IS IN THE ADF ENTRY TRAY |
| 4. THEN |
| 5. IF ONE ORIGINAL NEEDS TO BE RECOPIED |
| 5. THEN |
| 6. SET THE COUNT OF ONE IN THE ACCUMULATOR; |
| 5. ELSE |
| 6. IF TWO ORIGINALS NEED TO BE RECOPIED |
| 6. THEN |
| 7. SET THE COUNT OF TWO IN THE ACCUMULATOR; |
| 6. ELSE |
| 7. SET THE COUNT OF THREE IN THE ACCUMULATOR; |
| 6. ENDIF; |
| 5. ENDIF; |
| 5. ADD THE DISPLAYED RECOPY TO THE CUMULATIVE RECOPY COUNT; |
| 5. INHIBIT ADF STARTS UNTIL AFTER THE ADF HAS BEEN RESTACKED; |
| 5. IF THE ADF IS ACTIVE |
| 5. THEN |
| 6. SUSPEND THE ADF AT THE NEXT WAITING STATE; |
| 5. ENDIF; |
| 4. ENDIF; |
| 3. ENDIF; |
| 2. ELSE |
| 3. IF THE RECOVERY JOB HAS STARTED |
| 3. THEN |
| 4. RESET THE 'CUMULATIVE RECOPY COUNT HAS BEEN RECOMPUTED' FLAG; |
| 3. ENDIF; |
| 2. ENDIF; |
| 1. ENDIF; |

TABLE-continued

| RECOPCNT |
| --- |
| END SEGMENT (RECOPCNT); |

While the invention has been particularly shown and described with reference to a preferred embodiment thereof, it will be understood by those skilled in the art that the foregoing and other changes in form and details may be made therein without departing from the spirit and scope of the invention.

What is claimed is:

1. The method of job recovery from a paper jam in a document copier machine with an automatic document feed device for feeding original documents from a stack of documents serially to a processing station for production of images thereof, said machine having a copy paper path, a plurality of image bearing copy sheets being simultaneously transportable serially through said path, said sheets carrying diverse images, said machine having a control system capable of detecting the number of recopies needed for each original when the machine is shut down due to a paper jam or other work stoppage, and the number of originals needed to be recopied, comprising the steps of:

clearing said copy paper path of all copy sheets present in said path when a paper jam or other work stoppage occurs;

inhibiting further activity by said automatic document feed device, serially inserting N number of originals to be recopied into said processing station, N being a number greater than one;

producing the required number of recopies from each of said N number of originals to be recopied; and automatically reactivating said automatic document feed device upon the production of the last of the required number of recopies to resume the job suspended by the paper jam or other work stoppage and the recovery therefrom.

2. The method of claim 1 including the step of operating the automatic document feed device to place a next document at a staging station in preparation for entry to said processing station prior to the step of inhibiting further activity by the automatic document feed device, so that upon resumption of the suspended job the next original flows to the processing station immediately after the last of the N number of originals to be recopied has exited therefrom.

3. The method of claim 1 wherein said step of serially inserting N number of originals into said processing station is accomplished by using a semiautomatic document feed device included in the machine.

4. The method of claim 3 including the step of operating the automatic document feed device to place a next document at a staging station in preparation for entry to said processing station prior to the step of inhibiting further activity by the automatic document feed device, so that upon resumption of the suspended job the next original flows to the processing station immediately after the last of the N number of originals to be recopied has exited therefrom.

5. The method of job recovery from a paper jam in a document copier machine with an automatic document feed device for feeding original documents from a stack of documents serially to a processing station for production of images thereof, said machine having a copy paper path having the capability of serially transporting at one time a plurality of groups of copy sheets, each group corresponding to a different image, said machine having a control system capable of detecting the number of recopies needed in each group when the machine is shut down due to a paper jam or other work stoppage, and the number of originals needed to be recopied, comprising the steps of:

clearing said copy paper path of all copy sheets present in said path when said paper jam or other work stoppage occurs;

calling an incrementing procedure to add said number of recopies needed to a recopy counter;

inhibiting further activity by said automatic document feed device;

serially inserting N number of originals to be recopied into said processing station, N being a number greater than one;

calling a decrementing procedure to subtract one from the number in said recopy counter whenever a copy production occurs;

detecting when said recopy counter is equal to zero; and automatically reactivating said automatic document feed device to resume the job interrupted by the paper jam or other work stoppage and the recovery therefrom.

6. The method of claim 5 including the step of detecting conditions indicating that the job is in order for recovery and aborting the recovery procedure whenever it is not in such order.

7. The method of claim 5 wherein said machine also contains a semiautomatic document feed device operating independently of said automatic document feed device but synchronized therewith for automatically assisting in the insertion of a document into the processing station, wherein said step of serially inserting N number of originals into said processing station is accomplished by using said semiautomatic document feed device.

8. The method of claim 7 including the step of detecting conditions indicating that the job is in order for recovery and aborting the recovery procedure whenever it is not in such order.

9. The method of claim 7 including the step of operating the automatic document feed device to place a next document at a staging station in preparation for entry to said processing station prior to the step of inhibiting further activity by the automatic document feed device, so that upon resumption of the suspended job the next original flows to the processing station immediately after the last of the N number of originals to be recopied has exited therefrom.

* * * * *